US005216889A

United States Patent [19]

Herd et al.

[11] Patent Number: 5,216,889

[45] Date of Patent: Jun. 8, 1993

[54] COLD HEAD MOUNTING ASSEMBLY IN A CRYOSTAT DUAL PENETRATION FOR REFRIGERATED SUPERCONDUCTIVE MAGNETS

[75] Inventors: Kenneth G. Herd; Evangelos T. Laskaris, both of Schenectady, N.Y.

[73] Assignee: General Electric Company, Schenectady, N.Y.

[21] Appl. No.: 833,195

[22] Filed: Feb. 10, 1992

[51] Int. Cl.[5] ..... F25B 19/00

[52] U.S. Cl. ..... 62/51.1; 62/295; 505/892

[58] Field of Search ..... 505/892; 62/51.1, 295

[56] References Cited

U.S. PATENT DOCUMENTS

| | | | |
|---|---|---|---|
| 4,535,596 | 8/1985 | Laskaris | 62/51.1 |
| 4,635,450 | 1/1987 | Laskaris | 62/51.1 |
| 4,667,487 | 5/1987 | Miller et al. | 62/51.1 |
| 4,841,268 | 6/1989 | Burnett et al. | 62/51.1 |

*Primary Examiner*—Ronald C. Capossela

*Attorney, Agent, or Firm*—James R. McDaniel; Paul R. Webb, II

[57] ABSTRACT

This invention relates to cold head mounting assemblies in a cryostat dual penetration for refrigerated superconductive magnets. Such structures of this type, generally, allow heat to be conducted from the refrigerated superconductive magnet to the refrigeration cold head while isolating the magnet from the vibration created by the cold head.

8 Claims, 2 Drawing Sheets

COLD HEAD MOUNTING ASSEMBLY IN A CRYOSTAT DUAL PENETRATION FOR REFRIGERATED SUPERCONDUCTIVE MAGNETS

CROSS-REFERENCE TO RELATED APPLICATIONS

This application is related to commonly assigned U.S. patent application Ser. Nos. 07/833,225 and 07/833,194, all to Herd et al. and entitled "Thermal Busbar Assembly in a Cryostat Dual Penetration For Refrigerated Superconductive Magnets" and "High-Tc Superconducting Lead Assembly in a Cryostat Dual Penetration For Refrigerated Superconductive Magnets".

BACKGROUND OF THE INVENTION

1. Field of the Invention

This invention relates to cold head mounting assemblies in a cryostat dual penetration for refrigerated superconductive magnets. Such structures of this type, generally, allow heat to be conducted from the refrigerated superconductive magnet to the refrigeration cold head while isolating the magnet from the vibration created by the cold head.

2. Description of the Related Art

It is known in prior refrigerated superconductive magnets to use a cryorefrigeration system which employs a single cold head. The major limitation of these systems is the fact that if the single cold head malfunctions, the superconductive magnet may not be properly cooled, which could adversely affect the performance of the magnet. In short, the system typically was only as reliable as the cryorefrigerator itself. Therefore, a more advantageous system would be presented if this unreliability were reduced or eliminated.

In order to increase the reliability in refrigerated superconductive magnet systems, a redundant cold head system for a refrigerated magnet has been developed. Exemplary of such prior redundant systems is U.S. Pat. No. 5,111,665, to R. A. Ackermann, entitled "Redundant Cryorefrigerator System For a Refrigerated Superconductive Magnet", now allowed and assigned to the same assignee as the present invention. In U.S. Pat. No. 5,111,665 application, one cold head of the two used in the system cools the magnet. A redundant cold head does not contact the magnet and is held in a raised, standby position. If the main cold head malfunctions, the main cold head is raised so that it can be repaired, serviced or replaced and the redundant cold head is lowered to contact the magnet. In this manner, the cooling of the magnet should be substantially continuous. While this cryorefrigeration system has allowed the magnet to be run continuously, further reductions in the amount of vibration reaching the magnet would be achieved if the cold heads were not rigidly attached to the magnet. Vibration in the magnet is not desired because the vibration can cause artifacts in the image produced by the magnet. Consequently, further reductions in the vibration in the magnet while continuously cooling the magnet would be advantageous.

It is apparent from the above that there exists a need in the art for a cold head mounting assembly which conducts heat away from the magnet and towards the refrigerator cold head and which is capable of allowing the magnet to operate continuously without vibration but which at the same time allows the cold head to be removed without adversely affecting the magnet. It is a purpose of this invention to fulfill this and other needs in the art in a manner more apparent to the skilled artisan once given the following disclosure.

SUMMARY OF THE INVENTION

Generally speaking, this invention fulfills these needs by providing a dual cold head assembly for a superconductive magnet including a thermal shield and a vacuum enclosure, each said cold head assembly comprising first and second thermal stages, first and second thermal stations, first and second thermal station positioning means such that said first thermal station positioning means creates a first heat conduction path between said first thermal stage and said first thermal station, and said second thermal station positioning means creates a second heat conduction path between said second thermal stage and said second thermal station, and a connection means such that said first and second thermal station are thermally and flexibly connected to said thermal shield and said magnet.

In certain preferred embodiments, the first and second thermal stations are operating at temperatures of 50K and 10K, respectively. Also, the positioning means include jacking screws, a bellows, and O-rings.

In another further preferred embodiment, the cold heads reside in separate vacuum sleeves which have their own pumpout ports, separate from the main cryostat vacuum, which allow the cold heads to be removed without breaking the main vacuum.

The preferred cold head mounting assembly, according to this invention, offers the following advantages: cold head redundancy; easy cold head engagement and disengagement; and vibration isolation between the cold heads and the magnet. In fact, in many of the preferred embodiments, these factors of redundancy, engagement and disengagement, and vibration isolation are optimized to an extent considerably higher than heretofore achieved in prior, known cold head assemblies.

BRIEF DESCRIPTION OF THE DRAWINGS

The above and other features of the present invention which will become more apparent as the description proceeds, are best understood by considering the following detailed description in conjunction with the accompanying drawings wherein like characters represent like parts throughout the several views and in which.

DETAILED DESCRIPTION OF THE INVENTION

Figure 1:
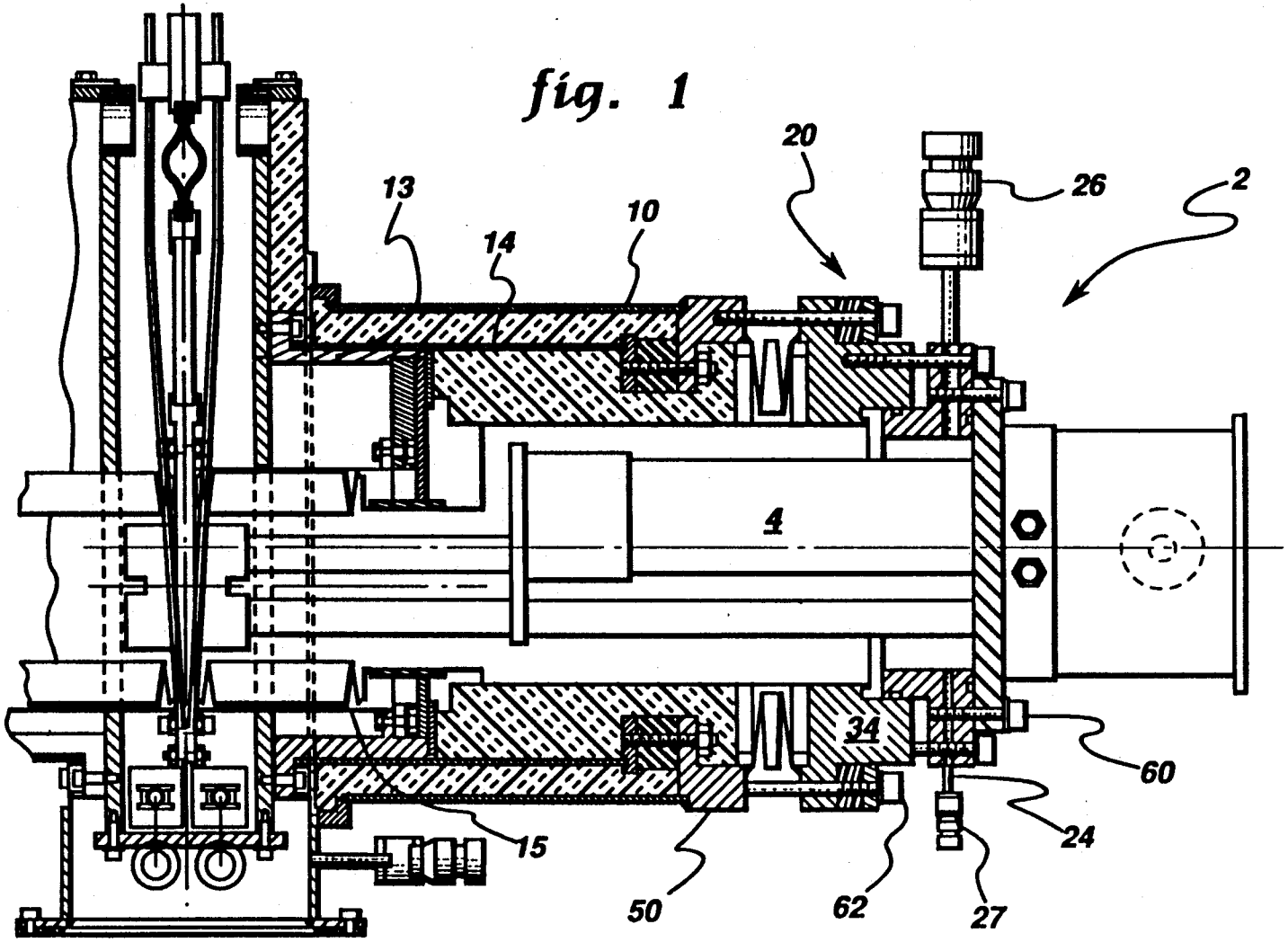
FIG. 1 is a side plan view of a cold head mounting assembly, according to the present invention, with the cold head thermal stages engaging the 10K and the 50K thermal stations.

With reference first to FIG. 1, there is illustrated a cold head mounting assembly 2. Assembly 2 includes, in part, cold head 4, 10K thermal station 6, and 50K thermal station 8. Cold head 4, preferably is a Cryomech GB-04 refrigerator manufactured by Cryomech. Stations 6 and 8, preferably, are constructed of OFHC copper. Vacuum enclosure 10 surrounds cold head 4 and is constructed of stainless steel. Located within enclosure 10 is thermal insulation 12. Thermal insulation 12, preferably, is constructed of multilayered aluminized mylar ® polyester film. The 50K support tube 14 is located between the 50K heat stack 13 and plate 56. 50° K. stack 13 is also connected to 50° K. thermal station 8 through flexible connection 17. Flexible connection 17, preferably, is constructed of laminated OFHC copper sheets. Tube 14, preferably, is constructed of stainless steel. 10K support tube 15 is located between 10K heat station 6 and 50K support plate 19. Plate 19, preferably, is constructed of stainless steel. Tube 15 is, preferably, constructed of thin-walled stainless steel. Cryocooler sleeve 16 is located adjacent to cold head 4. Sleeve 16, preferably, is constructed of thin-walled stainless steel.

Flange 23 is used to rigidly retain cold head 4 in place against thermal station 6,8. Cold head engagement assembly 20 is located adjacent to flange 23. A conventional sensor vacuum feedthrough 26 and sleeve vacuum pumpout 27 are located on assembly 20.

Figure 2:
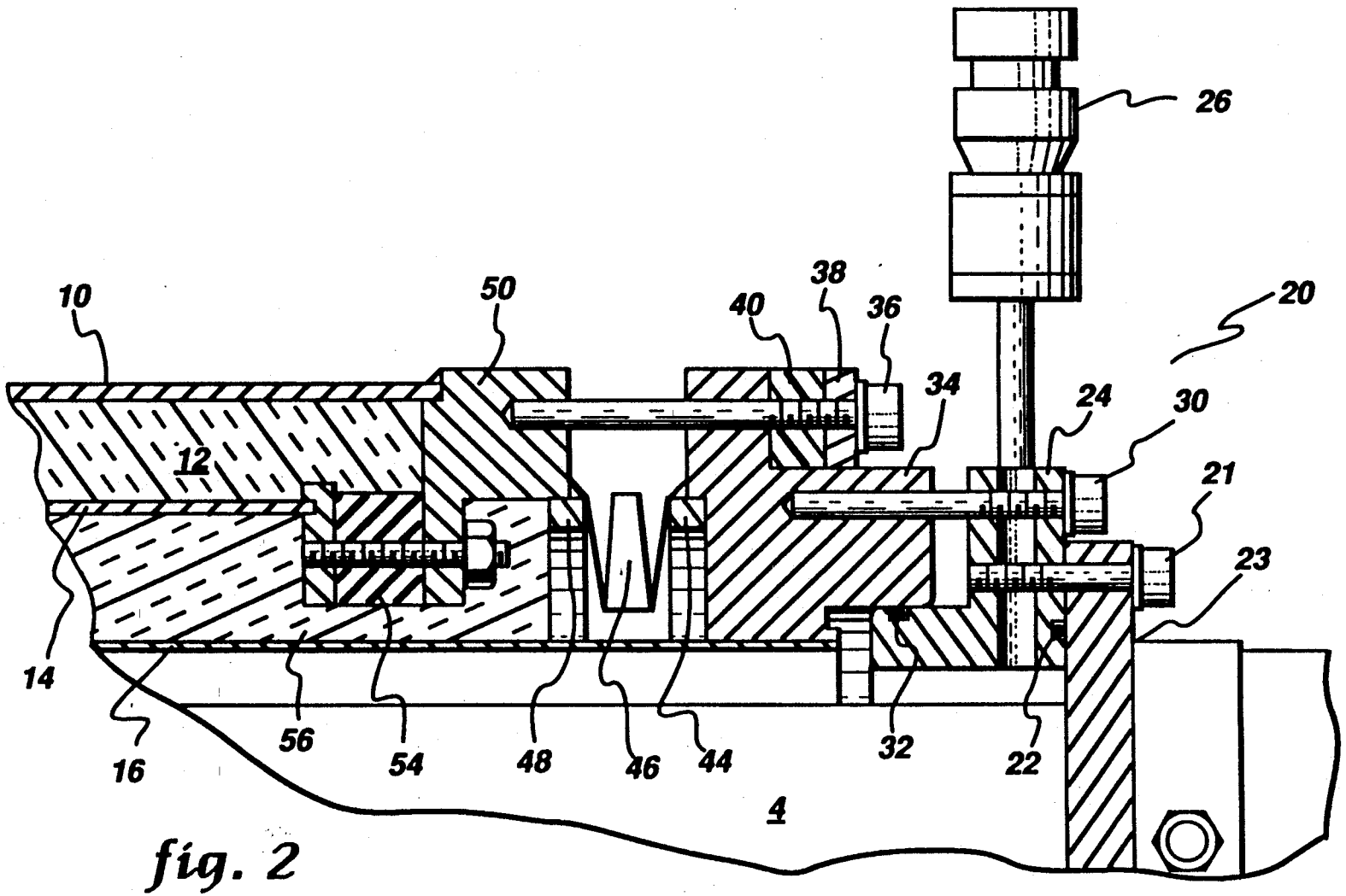
FIG. 2 is an enlarged view of the cold head mounting assembly taken from FIG. 1.

With respect to FIG. 2, the details of cold head engagement assembly 20 are set forth in greater detail. In particular, assembly 20 includes, in part, conventional fastener 21, elastomeric O-ring 22 and flange 23. O-ring 22 is manufactured by Parker Seals and is used to substantially prevent vacuum loss. Fastener 21 is engaged with threads to flange 24. Fastener 21 is used to retain a face seal made by O-ring 22 between flanges 23 and 24. Flanges 23 and 24, preferably, are constructed of stainless steel. A conventional sensor feedthrough 26 is welded to flange 24. A conventional fastener 30 is located on flange 24 and is engaged with threads into sleeve flange 34. A conventional jacking screw 60 (FIG. 1) is engaged with threads into flange 24 and contacts flange 34. Elastomeric O-ring 32 is located on flange 24. O-ring 32 is constructed of the same material as O-ring 22 and is used as a male gland seal between flanges 24 and 34 to prevent vacuum loss. The seal made by O-ring 32 allows motion between flanges 24 and 34.

Sleeve flange 34, preferably, is constructed of stainless steel. A conventional fastener 36 contacts plate 38 which, in turn, contacts an elastomeric vibration isolation gasket 40. A conventional jacking screw 62 (FIG. 1) is threaded into sleeve flange 34. Screw 62, then, contacts flange 50. Plate 38, preferably, is constructed of stainless steel. Fastener 36 is threaded into flange 50.

Located below flanges 34 and 50 is warm bellows 46. Bellows 46, preferably, is constructed of stainless steel. Bellows 46 is welded by conventional welding techniques to support extension 44 on flange 34 and extension 48 on flange 50.

Grommet vibration isolators 54, manufactured by the Lord Corporation, are fastened to support 50. Isolators 54 are also fastened to flange 56.

In the operation of assembly 2, the cold head resides in the sleeve vacuum contained by cryocooler sleeve 16. This allows the cold head 4 to be removed without breaking the main vacuum. Contact to the first thermal stage of cold head 4 is made by pulling the cold head 4 against the 50K thermal station 8 through fastener 30 using the cold head sleeve 16 to react to the contact force. The first stage thermal contact may be disengaged by separating the cold head 4 from the sleeve flange 34 using jacking screws 60. Contact to the second thermal stage of cold head 4 is made by pulling the cold head 4 against the 10K thermal station 6 through fastener 36 using the 10K support tube 15 and 50K support tube 14 to react to the contact force. The second stage thermal contact is disengaged by the separation of the cold head 4 from the sleeve flange 34 using jacking screw 62.

Once given the above disclosure, many other features, modifications and improvements will become apparent to the skilled artisan. Such features, modifications and improvements are, therefore, considered to be a part of this invention, the scope of which is to be determined by the following claims.

What is claimed is:

1. A dual cold head mounting assembly for a superconductive magnet including a thermal shield and a vacuum enclosure, each said cold head assembly comprised of:

first and second thermal stages;

first and second thermal stations;

first and second thermal station positioning means such that said first thermal station positioning means creates a first heat conduction path between said first thermal stage and said first thermal station and second thermal station positioning means creates a second heat conduction path between said second thermal stage and said second thermal station; and a connection means such that said first and second thermal stations are thermally and flexibly connected to said thermal shield and said magnet.

2. The assembly, according to claim 1, wherein said first thermal station positioning means is further comprised of:

a first support means;

a pressure loss reduction means substantially located on support means;

a second support means located at a predetermined distance away from said first support means; and a moving means substantially located on said support means.

3. The assembly, according to claim 1, wherein said second thermal station positioning means is further comprised of:

a first support means;

a plate means located on said support means;

a vibration reduction means located substantially adjacent to said plate means;

a second support means located at a predetermined distance away from said first support means; and a moving means substantially located on said support means.

4. The assembly, according to claim 1, wherein said assembly is further comprised of:

a bellows means substantially located between said first and second thermal station positioning means.

5. The assembly, according to claim 3, wherein said second thermal station positioning means is further comprised of:

a vibration reduction means located substantially adjacent to said second support means.

6. A method for positioning a refrigerator cold head in a superconductive magnet having first and second thermal station means, first and second thermal stage means, and first and second thermal station positioning means, said method comprised of the steps of:

operating said first thermal station positioning means such that a first heat conduction path is substantially created between said first thermal station means and said first thermal stage means; and operating said second thermal station positioning means such that a second heat conduction path is substantially created between said second thermal station means and said second thermal stage means; and reducing the vibration between said first and second thermal station means and said magnet.

7. The method, according to claim 6, wherein said step of operating said first thermal station positioning means is further comprised of the steps of:

rotating a threaded means; and sliding said cold head.

8. The method, according to claim 6, wherein said step of operating said second thermal station positioning means is further comprised of the steps of:

rotating a threaded means; and contacting said second thermal station substantially against said second thermal stage.

* * * * *